US011392780B1

(12) United States Patent
Tan et al.

(10) Patent No.: US 11,392,780 B1
(45) Date of Patent: Jul. 19, 2022

(54) ANALOG MULTIPLIER

(71) Applicant: Halo Microelectronics Co., Ltd., Foshan (CN)

(72) Inventors: Xiaoliang Tan, Foshan (CN); Guanhua Li, Foshan (CN); Chuang Lan, Foshan (CN)

(73) Assignee: Halo Microelectronics Co., Ltd., Foshan (CN)

( * ) Notice: Subject to any disclaimer, the term of this patent is extended or adjusted under 35 U.S.C. 154(b) by 0 days.

(21) Appl. No.: 17/678,446

(22) Filed: Feb. 23, 2022

(30) Foreign Application Priority Data

Jun. 9, 2021 (CN) ..... 202110639850.6

(51) Int. Cl.
*G06G 7/161* (2006.01)

(52) U.S. Cl.
CPC ..... *G06G 7/161* (2013.01)

(58) Field of Classification Search
CPC .... G06G 7/16; G06G 7/161; H03H 2021/001; H03K 2005/00156; G06F 7/523–5338; G06F 7/44–446; G06F 7/462–467; G06F 7/4812; G06F 7/487–4876; G06F 7/4915; G06F 7/496; G06F 7/498–4988; G06F 7/62; G06F 7/68
See application file for complete search history.

(56) References Cited

U.S. PATENT DOCUMENTS

| | | | | |
|---|---|---|---|---|
| 5,150,324 | A * | 9/1992 | Takasuka | G06G 7/161 708/835 |
| 5,459,464 | A * | 10/1995 | Beneteau | H03M 3/376 341/143 |
| 8,542,616 | B2 | 9/2013 | Staszewski et al. | |
| 2012/0154042 | A1* | 6/2012 | Nadimpalli | G06G 7/16 327/356 |
| 2013/0314109 | A1* | 11/2013 | Kremin | H03K 17/9622 324/686 |
| 2016/0352220 | A1* | 12/2016 | Kim | G06G 7/16 |
| 2019/0253039 | A1* | 8/2019 | Sicurella | H03K 5/24 |

FOREIGN PATENT DOCUMENTS

| | | | |
|---|---|---|---|
| CN | 2609058 | Y | 3/2004 |
| CN | 102662624 | A | 9/2012 |
| CN | 203326882 | U | 12/2013 |
| CN | 111398884 | A | 7/2020 |
| RU | 2382405 | C1 | 2/2010 |

* cited by examiner

*Primary Examiner* — Jyoti Mehta
*Assistant Examiner* — Carlo Waje
(74) *Attorney, Agent, or Firm* — Slater Matsil, LLP

(57) ABSTRACT

The analog multiplier includes a first signal input module, and a second signal input module or a third signal input module. The first signal input module is configured to output a frequency modulation signal. The second signal input module includes a first energy storage unit, a first switch unit, and a second switch unit. The first switch unit and the second switch unit are alternately turned on or turned off based on a frequency of the frequency modulation signal. The third signal input module includes a second energy storage unit, two third switch units, and two fourth switch units. The third switch unit and the fourth switch unit are alternately turned on or turned off based on the frequency of the frequency modulation signal.

15 Claims, 9 Drawing Sheets

ANALOG MULTIPLIER

PRIORITY CLAIM

This application claims the benefit of and priority to Chinese Patent Application No. 202110639850.6, filed Jun. 9, 2021, which is hereby incorporated by reference in its entirety.

TECHNICAL FIELD

The present disclosure relates to the technical field of electronics, and in particular, relates to an analog multiplier.

BACKGROUND

Analog multipliers are widely applied in the fields of modulation, demodulation, detection, and mixing of signals. For example, the analog multiplier is an important component of a modulator, a converter, a phase comparator, a power detector or the like.

The analog multiplier generally acquires a product of two contiguous signals.

In the related art, the architecture of some analog multipliers is constructed based on a first-level static model (that is, the Shichman-Hodges model) common in MOS transistors, whereas in some other analog multipliers, A/D and D/A converters are needed to implement functionality of the multipliers.

However, in the multiplier constructed based on the Shichman-Hodges model, for the sake of precision, the components of the multiplier need to operate in a saturated region or a sub-threshold region. This solution imposes stricter requirements on matching between the components, and hence the entire system is hard to implement. If the analog multiplier needs A/D and D/A converters, the entire system becomes complicated and hard to implement.

SUMMARY

Embodiments of the present disclosure are intended to provide an analog multiplier, such that functionality of the analog multiplier is implemented by a simpler structure.

In a first aspect of the embodiments of the present disclosure, an analog multiplier is provided. The analog multiplier is applicable to calculating a product of a first input analog signal and a second input analog signal. The analog multiplier includes a first signal input module, wherein the first signal input module is connected to the first input analog signal, and is configured to convert the first input analog signal into a frequency modulation signal with the first input analog signal as a carrier, a second signal input module or a third signal input module, wherein the second signal input module is connected to the first signal input module, and includes a first energy storage unit, a first switch unit, and a second switch unit, wherein a first terminal of the first energy storage unit is connected to a first voltage signal by the first switch unit, and is connected to a second voltage signal by the second switch unit, and a second terminal of the first energy storage unit is connected to ground, wherein the first switch unit and the second switch unit are alternately turned on or turned off based on a frequency of the frequency modulation signal, and the second switch unit is turned off in the case that the first switch unit is turned on and is turned on in the case that the first switch unit is turned off, wherein the third signal input module is connected to the first signal input module, and includes a second energy storage unit, two third switch units, and two fourth switch units, wherein a first terminal of the second energy storage unit is connected to the first voltage signal by a first third switch unit of the two third switch units, and is connected to ground by a first fourth switch unit of the two fourth switch units, and a second terminal of the second energy storage unit is connected to the second voltage signal by a second third switch unit of the two third switch units, and is connected to ground by a second fourth switch unit of the two fourth switch units, wherein the third switch unit and the fourth switch unit are alternately turned on or turned off based on the frequency of the frequency modulation signal, and the fourth switch unit is turned off in the case that the third switch unit is turned on and is turned on in the case that the third switch unit is turned off, and wherein the second input analog signal is a difference between the first voltage signal and the second voltage signal.

In an optional embodiment, the first signal input module includes a third energy storage unit, a fifth switch unit, a comparison unit, and a control unit, wherein a first terminal of the third energy storage unit is connected to the first input analog signal, a first terminal of the fifth switch unit, and a first terminal of the comparison unit, a second terminal of the third energy storage unit and a second terminal of the fifth switch unit are both connected to ground, the third energy storage unit is configured to be charged based on the first input analog signal in the case that the fifth switch unit is turned off, to be discharged in the case that the fifth switch unit is turned on to output the third voltage signal to the first terminal of the comparison unit, a second terminal of the comparison unit is connected to a reference voltage, an output terminal of the comparison unit is connected to a control terminal of the fifth switch unit, and the comparison unit is configured to output a control signal to the control terminal of the fifth switch unit based on the third voltage signal to control the fifth switch unit to be turned on or turned off, and the control unit is connected to the output terminal of the comparison unit, and is configured to acquire the frequency modulation signal based on the control signal, wherein in the case that the analog multiplier includes the second signal input module, the control unit is connected to both a control terminal of the first switch unit and a control terminal of the second switch unit, and wherein in the case that the analog multiplier includes the third signal input module, the control unit is connected to both a control terminal of the third switch unit and a control terminal of the fourth switch unit.

In an optional embodiment, the control signal is a pulse frequency modulation signal with the first input analog signal as a carrier, and the frequency modulation signal is a square-wave frequency modulation signal with the first input analog signal as a carrier.

In an optional embodiment, the third energy storage unit includes a first capacitor, wherein a first terminal of the first capacitor is connected to the first input analog signal, and a second terminal of the first capacitor is connected to ground.

In an optional embodiment, the fifth switch unit includes a fifth switch, wherein a first terminal of the fifth switch is connected to the first terminal of the third energy storage unit, a second terminal of the fifth switch is connected to ground, and a control terminal of the fifth switch is connected to the output terminal of the comparison unit.

In an optional embodiment, the comparison unit includes a comparator, wherein a first input terminal of the comparator is connected to the first terminal of the third energy storage unit, a second input terminal of the comparator is connected to the reference voltage, an output terminal of the comparator is connected to the control terminal of the fifth switch unit and the control unit.

In an optional embodiment, the control unit includes a D flip-flop, wherein a clock input terminal of the D flip-flop is connected to the output terminal of the comparison unit, an inverting output terminal of the D flip-flop is connected to a data input terminal of the D flip-flop and the control terminal of the second switch unit, and a non-inverting output terminal of the D flip-flop is connected to the control terminal of the first switch unit.

In an optional embodiment, the control unit is configured to, in the case that the first input analog signal is a current, the frequency of the frequency modulation signal is $$f_{sw} = \frac{I_{IN}(t)}{2c_1 v_0},$$

wherein $I_{IN}(t)$ represents a current value of the first input analog signal, c1 represents a capacitance value of the first capacitor, and v0 represents a voltage value of the reference voltage.

In an optional embodiment, the first signal input module includes a first resistor and a voltage-controlled oscillator, wherein a first terminal of the first resistor is connected to an input terminal of the voltage-controlled oscillator, and a second terminal of the first resistor is connected to ground, wherein in the case that the analog multiplier includes the second signal input module, an output terminal of the voltage-controlled oscillator is connected to both a control terminal of the first switch unit and a control terminal of the second switch unit, and wherein in the case that the analog multiplier includes the third signal input module, the output terminal of the voltage-controlled oscillator is connected to both a control terminal of the third switch unit and a control terminal of the fourth switch unit.

In an optional embodiment, the first energy storage unit includes a second capacitor, wherein a first terminal of the second capacitor is connected to a first terminal of the first switch unit and a first terminal of the second switch unit, a second terminal of the second capacitor is connected to ground, a second terminal of the first switch unit is connected to the first voltage signal, and a second terminal of the second switch unit is connected to the second voltage signal.

In an optional embodiment, in the case that the analog multiplier includes the second signal input module and a voltage value of the first voltage signal is greater than a voltage value of the second voltage signal, a current $I_{OUT}(t)$ flowing from the first voltage signal to the second voltage signal is $I_{out}(t)=V_{IN}(t)f_{sw}c\mathbf{2}$, wherein $f_{SW}$ represents a frequency of the frequency modulation signal, c2 represents a capacitance value of the second capacitor, and $V_{IN}(t)$ represents a voltage value of the second input analog signal.

In an optional embodiment, the first switch unit includes a first switch, and the second switch unit includes a second switch, wherein a first terminal of the first switch is connected to the first terminal of the first energy storage unit, a second terminal of the first switch is connected to the first voltage signal, and a control terminal of the first switch is connected to the first signal input module, and wherein a first terminal of the second switch is connected to the first terminal of the first energy storage unit, a second terminal of the second switch is connected to the second voltage signal, and a control terminal of the second switch is connected to the first signal input module.

In an optional embodiment, the second energy storage unit includes a third capacitor, wherein a first terminal of the third capacitor is connected to a first terminal of the first third switch unit and a first terminal of the first fourth switch unit, a second terminal of the third capacitor is connected to a first terminal of the second third switch unit and a first terminal of the second fourth switch unit, a second terminal of the first third switch unit is connected to the first voltage signal, a second terminal of the first fourth switch unit and a second terminal of the second fourth switch unit are both connected to ground, and a second terminal of the second third switch unit is connected to the second voltage signal.

In an optional embodiment, in the case that the analog multiplier includes the third signal input module and a voltage value of the first voltage signal is greater than a voltage value of the second voltage signal, a current $I_{OUT}(t)$ flowing from the first voltage signal to the second voltage signal is $I_{out}(t)=V_{IN}(t)f_{sw}c\mathbf{3}$, wherein $f_{SW}$ represents a frequency of the frequency modulation signal, c3 represents a capacitance value of the third capacitor, and $V_{IN}(t)$ represents a voltage value of the second input analog signal.

In an optional embodiment, the third switch unit includes a third switch, and the fourth switch unit includes a fourth switch, wherein the first terminal of the first third switch and the first terminal of the first fourth switch are both connected to the first terminal of the second energy storage unit, the second terminal of the first third switch is connected to the first voltage signal, the first terminal of the second third switch and the first terminal of the second fourth switch are both connected to the second terminal of the second energy storage unit, the second terminal of the second third switch is connected to the second voltage signal, the second terminal of the first fourth switch and the second terminal of the second fourth switch are both connected to ground, and a control terminal of the third switch and a control terminal of the fourth switch are connected to the first signal input module.

The present disclosure may achieve the following beneficial effects: Embodiments of the present disclosure provide an analog multiplier. The analog multiplier is applicable to calculating a product of a first input analog signal and a second input analog signal. The analog multiplier includes a first signal input module and a second signal input module, or a first signal input module and a third signal input module. The first signal input module is connected to the first input analog signal and is configured to convert the first input analog signal into a frequency modulation signal with the first input analog signal as a carrier. The second signal input module is connected to the first signal input module, and includes a first energy storage unit, a first switch unit, and a second switch unit. A first terminal of the first energy storage unit is connected to a first voltage signal by the first switch unit and is connected to a second voltage signal by the second switch unit, and a second terminal of the first energy storage unit is connected to ground. The first switch unit and the second switch unit are alternately turned on or turned off based on a frequency of the frequency modulation signal, and the second switch unit is turned off in the case that the first switch unit is turned on and is turned on in the case that the first switch unit is turned off. The third signal input module is connected to the first signal input module, and includes a second energy storage unit, two third switch units, and two fourth switch units. A first terminal of the second energy storage unit is connected to the first voltage signal by a first third switch unit of the two third switch units, and is connected to ground by a first fourth switch unit of the two fourth switch units, and a second terminal of the second energy storage unit is connected to the second voltage signal by a second third switch unit of the two third switch units, and is connected to ground by a second fourth switch unit of the two fourth switch units. The third switch unit and the fourth switch unit are alternately turned on or turned off based on the frequency of the frequency modulation signal, and the fourth switch unit is turned off in the case that the third switch unit is turned on and is turned on in the case that the third switch unit is turned off. The second input analog signal is a difference between the first voltage signal and the second voltage signal. It is apparent that whether the analog multiplier includes the first signal input module and the second signal input module, or the analog multiplier includes the first signal input module and the third signal input module, the first input analog signal and the second input are both related to the frequency of the frequency modulation signal. That is, by combining the relationship between the first input analog signal and the frequency of the frequency modulation signal, and the relationship between the second input analog signal and the frequency of the frequency modulation signal, the product of the first input analog signal and the second input analog signal may be calculated correspondingly. Meanwhile, A/D and D/A converters are not necessary. Therefore, in this way, the functionality of the analog multiplier is implemented with a relatively simple structure.

BRIEF DESCRIPTION OF THE DRAWINGS

One or more embodiments are illustrated by way of example, and not by limitation, in the figures of the accompanying drawings, wherein components having the same reference numeral designations represent like components throughout. The drawings are not to scale, unless otherwise disclosed.

DETAILED DESCRIPTION OF ILLUSTRATIVE EMBODIMENTS

For clearer descriptions of the objectives, technical solutions, and advantages of the embodiments of the present disclosure, the following clearly and completely describes the technical solutions in the embodiments of the present disclosure with reference to the accompanying drawings in the embodiments of the present disclosure. Apparently, the described embodiments are merely a part rather than all of the embodiments of the present disclosure.

All other embodiments obtained by a person of ordinary skill in the art based on the embodiments of the present disclosure without creative efforts shall fall within the protection scope of the present disclosure.

Figure 1:
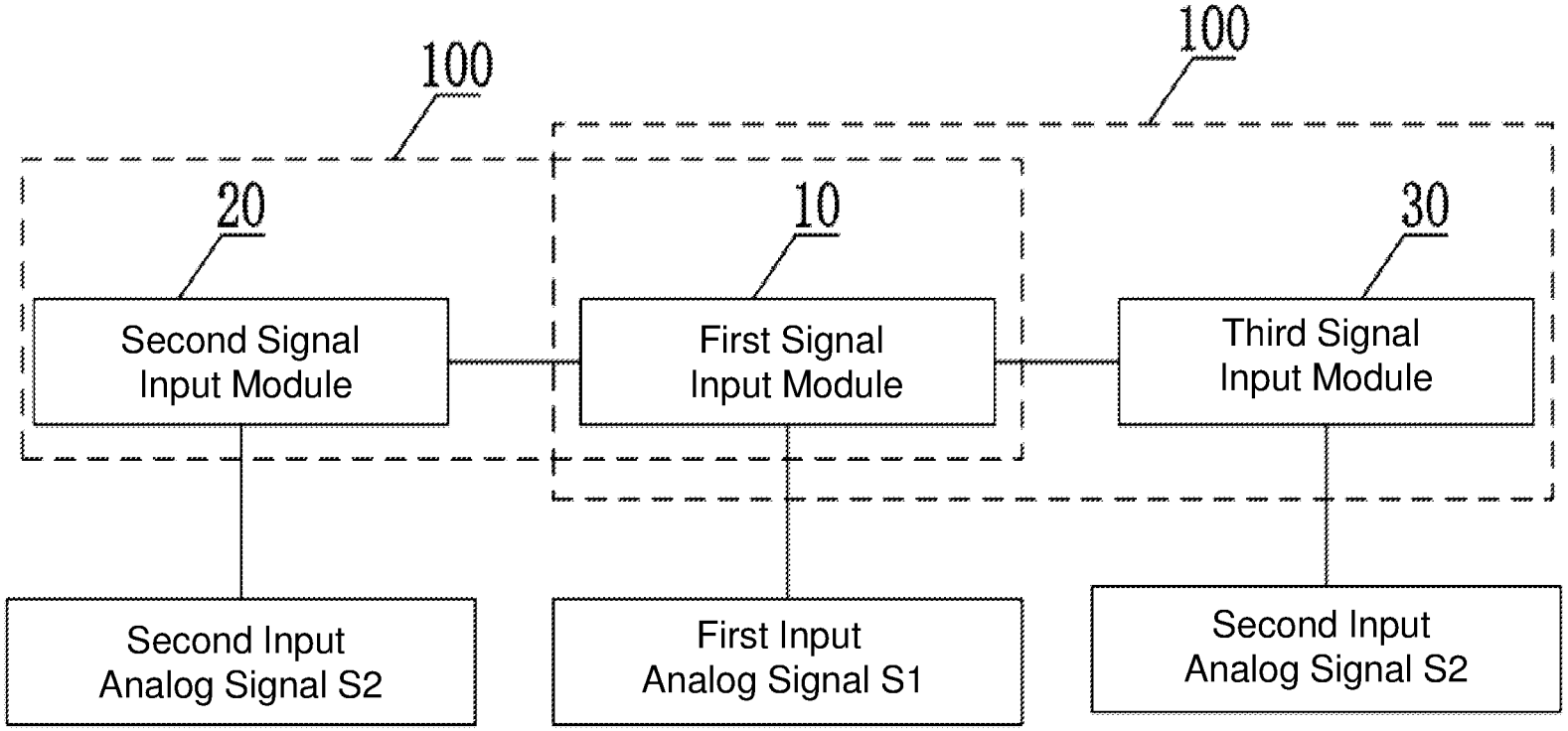
FIG. 1 is a schematic structural diagram of an analog multiplier according to an embodiment of the present disclosure.

Referring to FIG. 1, FIG. 1 is a schematic structural diagram of an analog multiplier according to an embodiment of the present disclosure.

As illustrated in FIG. 1, an analog multiplier 100 includes a first signal input module 10 and a second signal input module 20. Alternatively, the analog multiplier 100 includes a first signal input module 10 and a third signal input module 30.

The analog multiplier is applicable to calculating a product of a first input analog signal and a second input analog signal, that is, the product of a first input analog signal S1 and a second input analog signal S2 is calculated under cooperation between the first signal input module 10 and the second signal input module 20, or is calculated under cooperation between the first signal input module 10 and third signal input module 30.

Specifically, the first signal input module 10 is connected to both the first input analog signal S1 and the second signal input module 20, and the first signal input module 10 is configured to convert the first input analog signal S1 into a frequency modulation signal with the first input analog signal S1 as a carrier.

Figure 2:
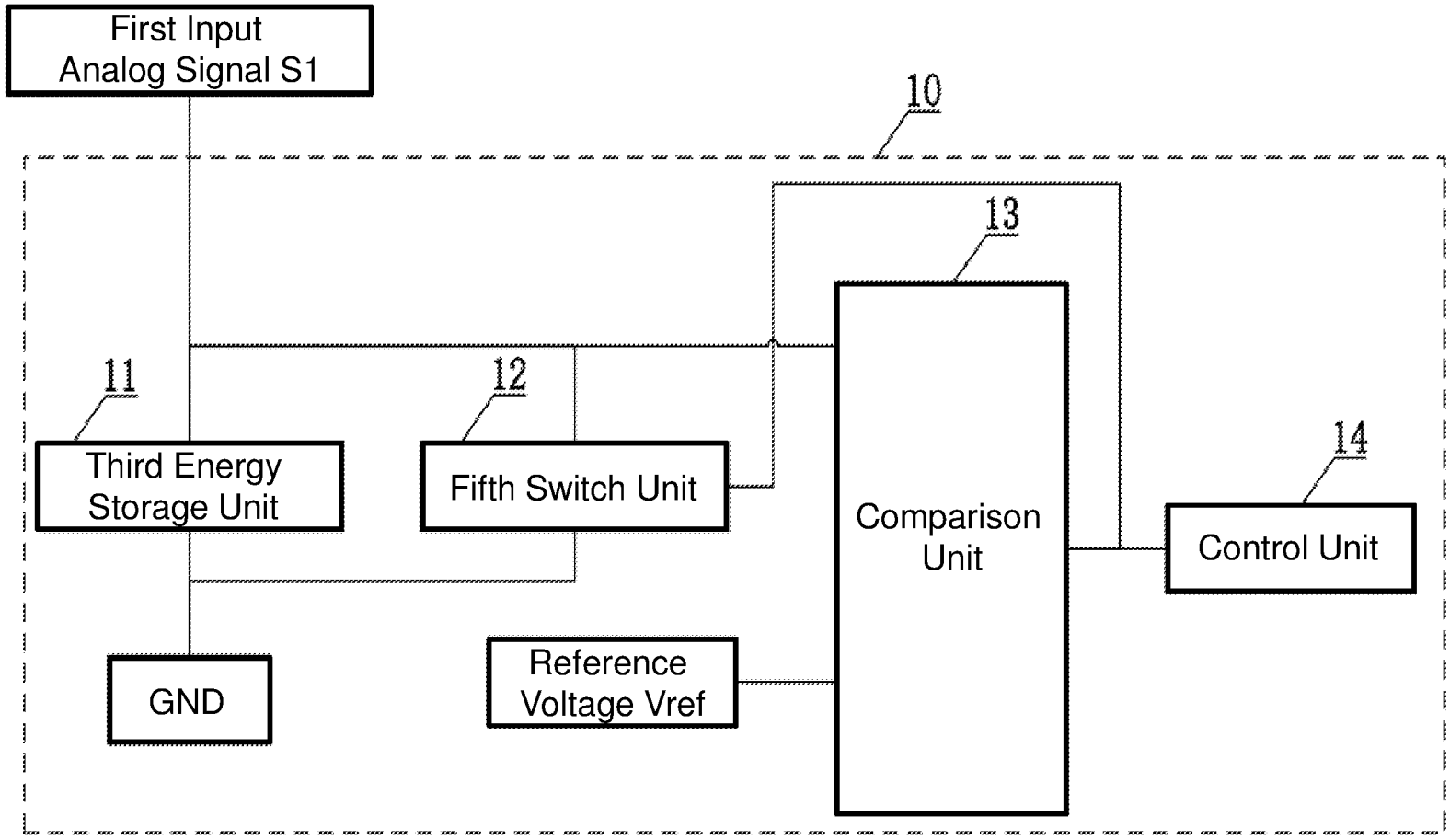
FIG. 2 is a schematic structural diagram of a first signal input module according to an embodiment of the present disclosure.

In an embodiment, as illustrated in FIG. 2, the first signal input module 10 includes a third energy storage unit 11, a fifth switch unit 12, a comparison unit 13, and a control unit 14.

A first terminal of the third energy storage unit 11 is connected to the first input analog signal S1, a first terminal of the fifth switch unit 12, and a first terminal of the comparison unit 13. A second terminal of the third energy storage unit 11 and a second terminal of the fifth switch unit 12 are both connected to ground. A second terminal of the comparison unit 13 is connected to a reference voltage Vref. An output terminal of the comparison unit 13 is connected to a control terminal of the fifth switch unit 12. The control unit 14 is connected to the output terminal of the comparison unit 13.

Specifically, the fifth switch unit 12 is controlled by a control signal output of the comparison unit 13. For example, in the case that the comparison unit 13 outputs a high-level signal, the fifth switch unit 12 is turned on. In the case that the comparison unit 14 outputs a low-level signal, the fifth switch unit 12 is turned off.

Then, in the case that the fifth switch unit 12 is turned on, the third energy storage unit 11 is discharged via the fifth switch unit 12, and in the case that the fifth switch unit is turned off, the first input analog signal S1 charges the third energy storage unit 11.

In addition, the first terminal of the third energy storage unit 11 is connected to the first terminal of the comparison unit 13. That is, a voltage at the first terminal of the third energy storage unit 11 is equal to a voltage at the first terminal of the comparison unit 13. With the charging or discharging of the third energy storage unit 11, a voltage of a third voltage signal at the first terminal of the third energy storage unit 11 also changes. That is, a voltage input of the first terminal of the comparison unit 13 also changes. For example, in the case that the third energy storage unit 11 is charged, the voltage of the third voltage signal at the first terminal of the third energy storage unit 11 increases, and the voltage input by the first terminal of the comparison unit 13 also increases. In the case that the voltage is greater than the reference voltage Vref, it is assumed that the control signal output of the comparison unit 13 is a first level signal. On the contrary, in the case that the third energy storage unit 11 is discharged, the voltage input by the first terminal of the comparison unit 13 decreases. In the case that the voltage is less than the reference voltage Vref, it is assumed that the control signal output of the comparison unit 13 is a second level signal.

It may be understood that in response to the first level signal being a high-level signal, the second level signal is a low-level signal. In response to the first level signal being a low-level signal, the second level signal is a high-level signal.

Finally, the comparison unit 13 transmits to the control unit 14 the control signal output of the comparison unit 13, and the control unit 14 outputs the frequency modulation signal based on the control signal.

Figure 3:
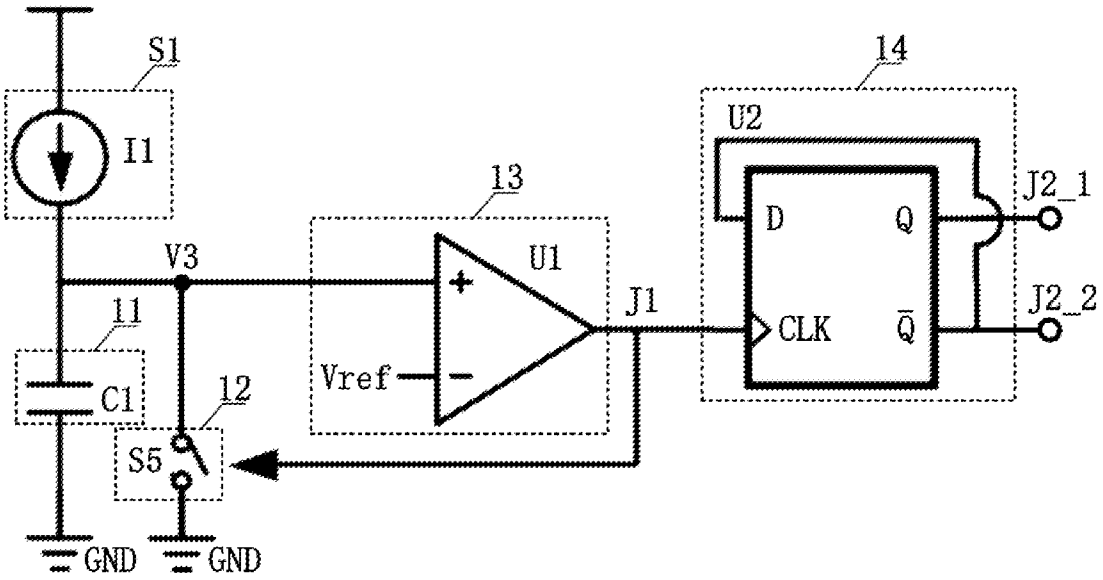
FIG. 3 is a schematic circuit structural diagram of the first signal input module according to an embodiment of the present disclosure.

For better understanding of the implementation process of the above embodiment, a circuit structure of the first signal input module as illustrated in FIG. 3 is illustrated as an example.

As illustrated in FIG. 3, in this case, the first input analog signal S1 is a time-varying current signal I1.

In an embodiment, the third energy storage unit 11 includes a first capacitor C1. A first terminal of the first capacitor C1 is connected to the first input analog signal S1, that is, the first terminal of the first capacitor C1 is connected to the current signal I1. A second terminal of the first capacitor C1 is connected to ground.

Optionally, the fifth switch unit 12 includes a fifth switch S5. A first terminal of the fifth switch S5 is connected to the first terminal of the third energy storage unit 11, that is, the first terminal of the fifth switch S5 is connected to the first terminal of the first capacitor C1. A second terminal of the fifth switch S5 is connected to ground. A control terminal of the fifth switch S5 is connected to the output terminal of the comparison unit 13.

The fifth switch S5 may be a relay, a metal-oxide semiconductor field-effect transistor (MOSFET), an insulated gate bipolar transistor (IGBT), or the like.

Optionally, the comparison unit 13 includes a comparator U1. A non-inverting input terminal of the comparator U1 is connected to the first terminal of the third energy storage unit 11, that is, the non-inverting input terminal of the comparator U1 is connected to the first terminal of the first capacitor C1. An inverting input terminal of the comparator U1 is connected to the reference voltage Vref. An output terminal J1 of the comparator U1 is connected to the control terminal of the fifth switch unit 12 (that is, the control terminal of the fifth switch) and the control unit 14.

It may be understood that in other embodiments, the inverting input terminal of the comparator U1 is connected to the first terminal of the first capacitor C1, and the non-inverting input terminal of the comparator U1 is connected to the reference voltage Vref.

Optionally, the control unit 14 includes a D flip-flop U2. A clock input terminal CLK of the D flip-flop U2 is connected to the output terminal of the comparison unit 13, that is, the clock input terminal CLK of the D flip-flop U2 is connected to the output terminal of the comparator U1. An inverting output terminal of the D flip-flop U2 is connected to a data input terminal D of the D flip-flop U2. A control terminal of a second switch unit 23 via an interface J2_2, and a non-inverting output terminal Q of the D flip-flop U2 is connected to a control terminal of the first switch unit 22 via an interface J2_1.

It should be understood that in this embodiment, the flip-flop used herein is a four-port D flip-flop having a clock input terminal, a data input terminal, a non-inverting output terminal, and an inverting output terminal.

In other embodiments, since different types of flip-flops are available, the specific pin definitions and connection modes may be different depending on different types of flip-flops (such as a T flip-flop or a JK flip-flop). However, regarding these flip-flops, the functions and the signal definitions are the same. Specifically, in these flip-flops, the input control signal modulated by a pulse frequency is connected to the clock input terminal of the flip-flop. The control signal is converted into a square-wave frequency modulation signal, and the square-wave frequency modulation signal is used to control subsequent switch units.

In addition, in some embodiments, in the case that the flip-flop used herein has only one output terminal, two complementary signals are output on the premise of generating two inverting control signal outputs based on the output of the flip-flop only by adding a logic circuit (e.g., an inverter).

It is apparent that in the case that other types of flip-flops are used, the flip-flop may be configured in a manner similar to the above embodiment, which is within the scope and easily understood by a person skilled in the art, and is not described herein any further.

In practice, the fifth switch S5 is controlled by the control signal generated by the output terminal of the comparator U1. In the case that the control signal controls the fifth switch S5 to be turned off, the current signal I1 charges the first capacitor C1. In the case that the control signal controls the fifth switch S5 to be turned on, the voltage $V_{C1}(t)$ of a third voltage signal V3 at the first terminal of the first capacitor C1 is pulled down to ground. That is, the first capacitor C1 is discharged, and the voltage $V_{C1}(t)$ of the third voltage signal V3 is:

$$V_{c1}(t) = \frac{I_{IN}(t)t}{c_1} \cdot I_{IN}(t)$$

represents a current value of the current signal I1, t represents time, and c1 represents a capacitance value of the first capacitor C1. The value of $V_{C1}(t)$ is obtained by multiplying $I_{IN}(t)$ by t and then divided by c1 as shown in the equation above.

In the case that the first capacitor C1 is charged, the voltage $V_{C1}(t)$ of the third voltage signal V3 increases. In the case that the first capacitor C1 is discharged, the voltage $V_{C1}(t)$ of the third voltage signal V3 decreases.

In the case that the voltage $V_{C1}(t)$ of the third voltage signal V3 increases to be greater than the reference voltage Vref, the control signal output by the output terminal J1 of the comparator U1 is a high level signal. The high-level signal simultaneously causes the fifth switch S5 to be turned on.

Then the voltage $V_{C1}(t)$ of the third voltage signal V3 quickly decreases again. In the case that the voltage $V_{C1}(t)$ of the third voltage signal V3 decreases to be less than the reference voltage Vref, the control signal is converted into a low level signal. The low-level signal controls the fifth switch S5 to be turned off, and the first capacitor C1 starts to be charged again by the current signal I1.

The above process is constantly repeated, such that the control signal is constantly switched between high and low levels, and a pulse sequence is generated. An interval between pulses changes with an amplitude of the input current signal I1.

In the case that the amplitude of the input current signal I1 increases, the time required to charge the first capacitor C1 to the reference voltage Vref decreases. The interval between the pulses in the pulse sequence of the control signal becomes smaller, and the frequency of the control signal increases.

Conversely, in the case that the amplitude of the input current signal I1 decreases, the time required to charge the first capacitor C1 to the reference voltage Vref increases. The interval between the pulses in the pulse sequence of the control signal becomes larger, and the frequency of the control signal decreases.

It is apparent that the control signal is a pulse frequency modulation (PFM) signal with the first input analog signal as the carrier. The PFM refers to a pulse modulation technique, and the frequency of the modulation signal changes with the amplitude of the input signal whereas a duty cycle remains unchanged.

Hence, the control unit 14 acquires the frequency modulation signal based on the control signal. Specifically, the control signal generated by the output terminal J1 of the comparator U1 is fed into the clock input terminal of the D flip-flop U2.

Before a rising edge of the control signal generated by the clock input terminal of the D flip-flop U2 arrives, the frequency modulation signal generated by the non-inverting output terminal of the D flip-flop U2 takes the value of the input level of the data input terminal D, and the state of the frequency modulation signal generated by the non-inverting output terminal of the D flip-flop U2 changes only in the case that the rising edge of the control signal generated by the clock input terminal of the D flip-flop U2 arrives.

The inverting output terminal of the D flip-flop U2 is connected to the data input terminal D thereof, such that the output of the D flip-flop U2 repeatedly switches the level on the non-inverting output terminal of the D flip-flop U2 at a frequency half of the frequency of the signal at the clock input terminal.

In addition, since the control signal is a pulse frequency modulation signal with the first input analog signal as the carrier, the frequency modulation signal is a square wave frequency modulation (SWFM) signal. A frequency of the square wave frequency modulation signal is half of a frequency of the pulse frequency modulation signal. The square wave frequency modulation refers to generating a square wave pulse frequency modulation signal with equal amplitude and unequal width by frequency modulation on the square wave using an analog baseband signal carrying information. The square wave pulse frequency varies with the amplitude of the input analog baseband signal.

Figure 4:
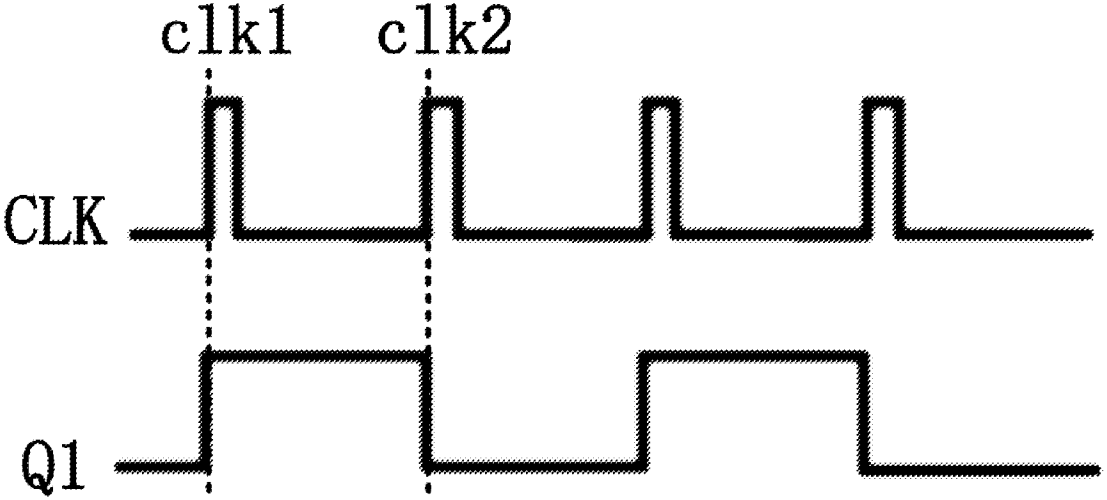
FIG. 4 is a schematic diagram of a control signal and a signal output by a non-inverting output terminal of a D flip-flop according to an embodiment of the present disclosure.

For example, in an embodiment, as illustrated in FIG. 4, assuming that a control signal fed into the clock input terminal of the D flip-flop U2 is a pulse frequency modulation signal CLK, a frequency modulation signal generated by the non-inverting output terminal of the D flip-flop U2 is a square-wave frequency modulation signal Q1.

In the case that each time a rising edge of the pulse frequency modulation signal CLK arrives, the square wave frequency modulation signal Q1 is switched between high and low levels. For example, at a rising edge clk1 of the pulse frequency modulation signal CLK, the square wave frequency modulation signal Q1 is switched from a low level to a high level. At a rising edge clk2 of the pulse frequency modulation signal CLK, the square wave frequency modulation signal Q1 is switched from a high level to a low level.

Thus, the frequency $f_{SW}$ of the frequency modulation signal is:

$$f_{sw} = \frac{I_{IN}(t)}{2c_1 v_0}.$$

$I_{IN}(t)$ represents a current value of the first input analog signal (that is, the current value of the current signal I1), c1 represents the capacitance value of the first capacitor C1, and v0 represents a voltage value of the reference voltage Vref. The frequency $f_{SW}$ of the frequency modulation signal is obtained by dividing $I_{IN}(t)$ by the product of c1 and v0.

It should be noted that the hardware structure of the first signal input module 10 as illustrated in FIG. 3 is only an example, and the first signal input module 10 may have more or fewer components than those as illustrated in the drawings. Two or more components may be combined, or different component configurations may be provided. The various components illustrated in the drawings may be implemented in hardware, software, or a combination of hardware and software, including one or more signal processing and/or dedicated integrated circuits.

Figure 5:
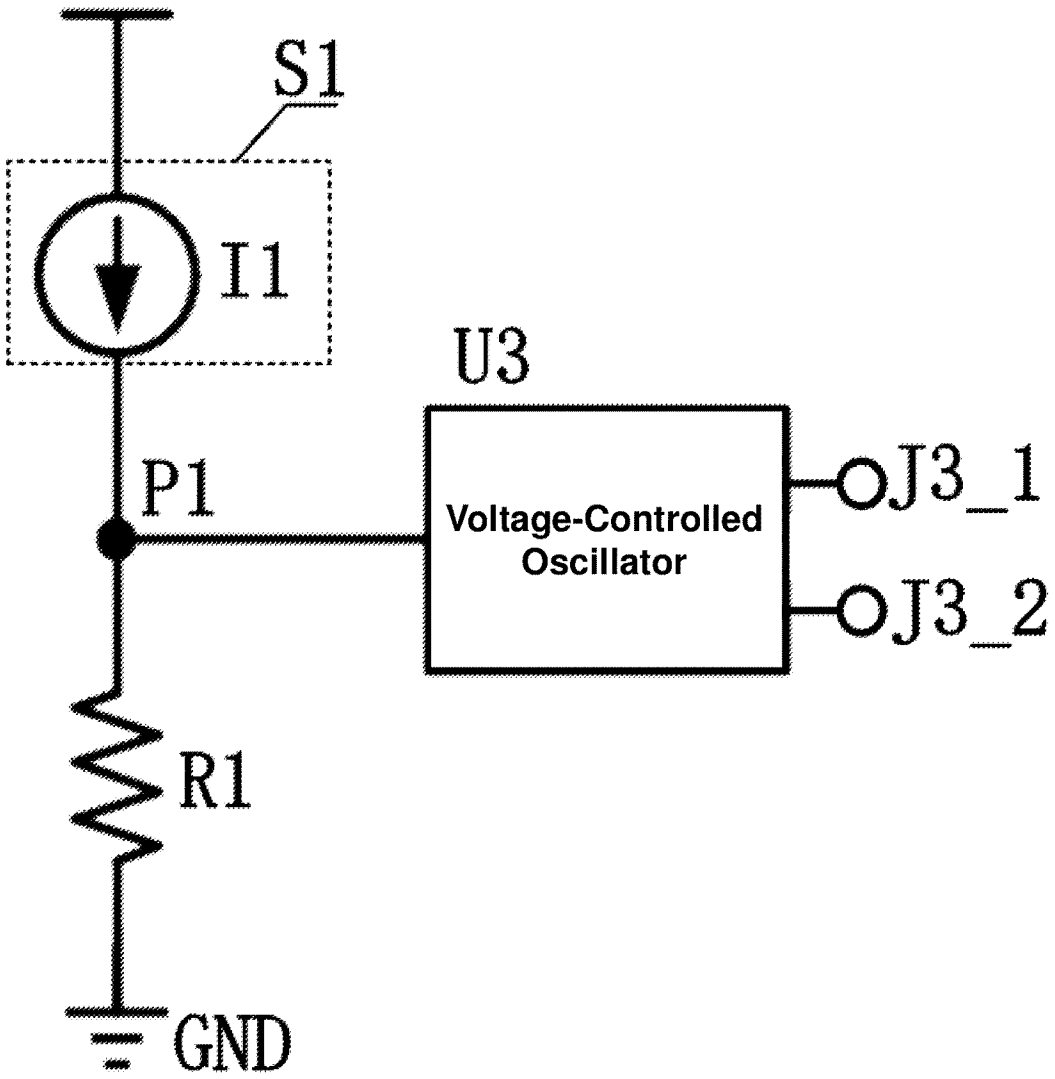
FIG. 5 is a schematic circuit structural diagram of a first signal input module according to another embodiment of the present disclosure.

For example, as illustrated in FIG. 5, FIG. 5 is a schematic circuit structural diagram of a first signal input module according to another embodiment of the present disclosure.

The first signal input module 10 includes a first resistor R1 and a voltage-controlled oscillator U3. A first terminal of the first resistor R1 is connected to an input terminal of the voltage-controlled oscillator U3, and a second terminal of the first resistor R1 is connected to ground GND. Both the output terminal J3_1 and the output terminal J3_2 of the voltage-controlled oscillator U3 are configured to output a frequency modulation signal.

The voltage-controlled oscillator is a circuit configured to convert a level into a frequency modulation signal with a corresponding frequency, or a circuit configured to output a frequency modulation signal with a frequency in proportion to a level of an input signal.

Specifically, the current signal I1 flows through the first resistor R1, such that a voltage fed into the voltage-controlled oscillator U3 is generated at a connection point P1. This voltage is denoted as VR, and $Vr=_{IN}(t)\times r1$. Vr represents a voltage value of the voltage VR, $I_{IN}(t)$ represents the current value of the current signal I1, and r1 represents a resistance value of the first resistor R1. Vr is the product of $I_{IN}(t)$ and r1.

In the case that the voltage VR passes through the voltage-controlled oscillator U3, the frequency of the frequency modulation signal generated by the voltage-controlled oscillator U3 may be proportional to the voltage VR, that is, the frequency of the frequency modulation signal is: $f_{SW}=K\times Vr$. K represents a control characteristic value of the voltage-controlled oscillator, Vr represents the voltage value of the voltage VR, that is, $f_{SW}$ is the product of K and Vr, such that the input current signal I1 is converted into the frequency modulation signal.

It should be understood that in this embodiment, the voltage-controlled oscillator U3 is a voltage-controlled oscillator having two output ports, and the two output ports output two complementary signals.

In other embodiments, since different types of voltage-controlled oscillators are available, the specific pin definitions may be different depending on the different types of voltage-controlled oscillators. However, regarding these oscillators, the functions and the signal definitions are the same.

For example, in an embodiment, in the case that the voltage-controlled oscillator used herein has only one output terminal, two complementary signals are output only by adding an inverter on one signal.

It is apparent that in the case that other types of voltage-controlled oscillators are used, the voltage-controlled oscillator may be configured in a manner similar to that in the above embodiment, which is within the scope and easily understood by a person skilled in the art, and is not described herein any further.

Figure 6:
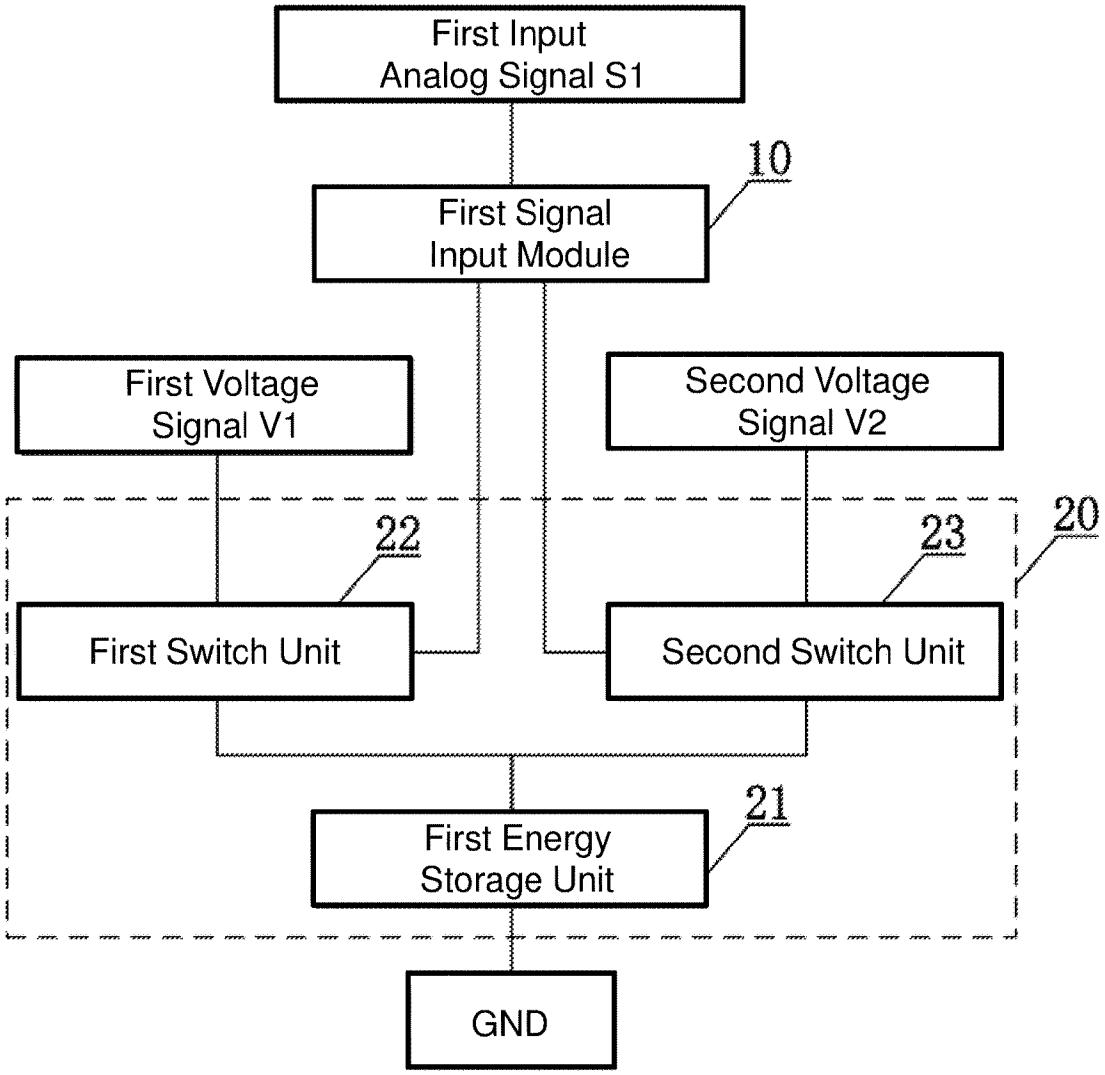
FIG. 6 is a schematic structural diagram of connection between the first signal input module and a second signal input module according to an embodiment of the present disclosure.

Referring to FIG. 6 in combination with FIG. 1, FIG. 6 is a schematic circuit structural diagram of connection between the first signal input module 10 and the second signal input module 20 according to an embodiment of the present disclosure.

The second signal input module 20 is connected to the first signal input module 10, and includes a first energy storage unit 21, a first switch unit 22, and a second switch unit 23.

Specifically, a first terminal of the first energy storage unit 21 is connected to a first voltage signal V1 through the first switch unit 22, and the first terminal of the first energy storage unit 21 is connected to a second voltage signal V2 through the second switch unit 23. A second terminal of the first energy storage unit 21 is connected to ground GND. In addition, a control terminal of the first switch unit 22 is connected to the first signal input module 10, and a control terminal of the second switch unit 23 is connected to the first signal input module 10.

The first energy storage unit 21 is configured to be connected to the first voltage signal V1 in the case that the first switch unit 22 is turned on, and connected to the second voltage signal V2 in the case that the second switch unit 23 is turned on.

The first switch unit 22 and the second switch unit 23 are alternately turned on or turned off based on a frequency of the frequency modulation signal, and the second switch unit 23 is turned off in the case that the first switch unit 22 is turned on, and the second switch unit 23 is turned on in the case that the first switch unit 22 is turned off.

In addition, the second input analog signal is a difference between the first voltage signal V1 and the second voltage signal V2. That is, the voltage of the second input analog signal is a difference between the voltage of the first voltage signal V1 and the voltage of the second voltage signal V2.

Figure 7:
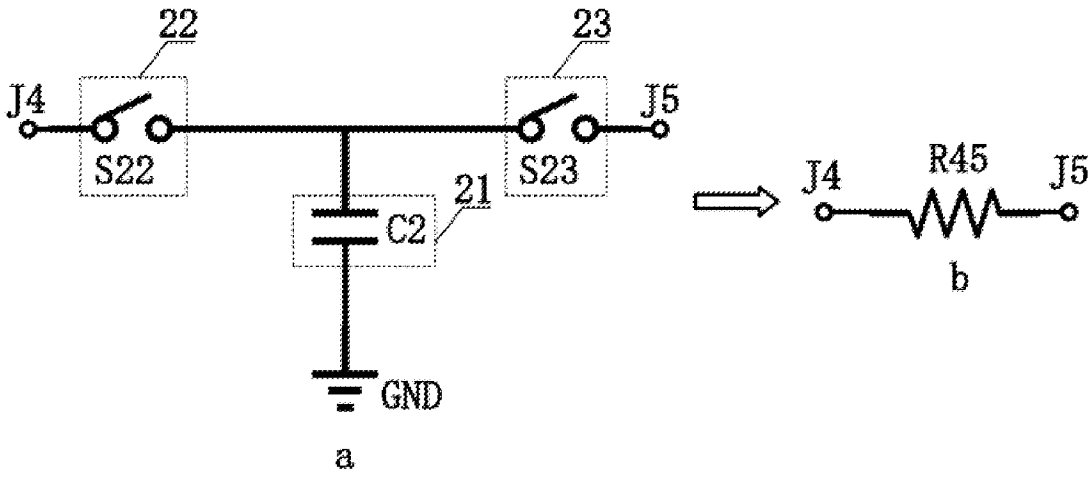
FIG. 7 is a schematic circuit structural diagram of the second signal input module according to an embodiment of the present disclosure.

Optionally, referring to FIG. 7 together, as illustrated in diagram in FIG. 7, the first energy storage unit 21 includes a second capacitor C2.

A first terminal of the second capacitor C2 is connected to a first terminal of the first switch unit 22 and a first terminal of the second switch unit 23. A second terminal of the second capacitor C2 is connected to ground GND. A second terminal of the first switch unit 22 is connected to the first voltage signal V1 through a port J4, and a second terminal of the second switch unit 23 is connected to the second voltage signal V2 through a port J5.

Optionally, the first switch unit 22 includes a first switch S22, and the second switch unit 23 includes a second switch S23. A first terminal of the first switch S22 is connected to the first terminal of the first energy storage unit 21, that is, the first terminal of the first switch S22 is connected to the first terminal of the second capacitor C2. A second terminal of the first switch S22 is connected to the first voltage signal V1 by the port J4. A control terminal of the first switch S22 is connected to the first signal input module 10.

A first terminal of the second switch S23 is connected to the first terminal of the first energy storage unit 21, that is, the first terminal of the second switch S23 is connected to the first terminal of the second capacitor C2. A second terminal of the second switch S23 is connected to the second voltage signal V2 by the port J5. A control terminal of the second switch S23 is connected to the first signal input module 10.

Specifically, it may be seen from the above description that both the first switch S22 and the second switch S23 are alternately turned on based on the frequency modulation signal generated by the first signal input module 10. That is, the switching frequencies of the first switch S22 and the second switch S23 are equal to the frequency of the frequency modulation signal. In addition, the second switch S23 is turned off in the case that the first switch S22 is turned on, and the second switch S23 is turned on in the case that the first switch S22 is turned off.

In the case that the first switch S22 is turned on and the second switch S23 is turned off, the first terminal of the second capacitor C2 is connected to the first voltage signal V1 through the first switch S22, and the first voltage signal V1 causes a total charge on the second capacitor C2 to be equal to the following: Q1=v1($t$)×c2, wherein v1($t$) represents a voltage value of the first voltage signal V1, and c2 represents a capacitance value of the second capacitor C2. Q1 is equal to the product of v1($t$) and c2.

In the case that the second switch S23 is turned on and the first switch S22 is turned off, the first terminal of the second capacitor C2 is connected to the second voltage signal V2 through the second switch S23, and the second voltage signal V2 causes a total charge on the second capacitor C2 to be equal to the following: Q2=v2($t$)×c2, wherein v2($t$) represents a voltage value of the second voltage signal V2, and c2 represents a capacitance value of the second capacitor C2. Q2 is equal to the product of v2($t$) and c2.

Assuming that the voltage value v1($t$) of the first voltage signal V1 is greater than the voltage value v2($t$) of the second voltage signal V2, then a difference of charge between the total charge Q1 and the total charge Q2 generates a current flowing from the first voltage signal V1 to the second voltage signal V2.

As illustrated in diagram b in FIG. 7, in this case, the port J4 and the port J5 may be equivalent to an equivalent resistance R45, and the current flowing through the resistance is the current flowing from the first voltage signal V1 to the second voltage signal V2.

This current is denoted as current $I_{out}(t)=V_{IN}(t)f_{sw}c2$. $f_{SW}$ represents the frequency of the frequency modulation signal, c2 represents the capacitance value of the second capacitor C2, and $V_{IN}(t)$ is the voltage value of the second input analog signal. From the above content, it may be seen that the voltage value of the second input analog signal S2 is the difference between the voltage value of the first voltage signal V1 and the voltage value of the second voltage signal V2, that is, $V_{IN}(t)=v1(t)-v2(t)$.

In addition, it may be understood that one of the first voltage signal V1 and the second voltage signal V2 may be a ground signal. For example, the first terminal of the second capacitor C2 is connected to the first voltage signal V1 via the first switch S22, and the first terminal of the second capacitor C2 is also connected to ground through the second switch S23. The specific implementation process is similar to the above embodiment, which is within the scope and easily understood by a person skilled in the art, and is not described herein any further.

In summary, in the case that the analog multiplier includes the first signal input module 10 and the second signal input module 20, the first input analog signal S1 and the second input analog signal S2 are both related to the frequency of the frequency modulation signal, and the product of the first input analog signal S1 and the second input analog signal S2 is correspondingly calculated.

Description is given using the first signal input module 10 as illustrated in FIG. 3 and the second signal input module 20 as illustrated in FIG. 7 as examples.

In this case, as known from the above embodiments, the frequency $f_{SW}$ of the frequency modulation signal is:

$$f_{sw} = \frac{I_{IN}(t)}{2c_1 v_0},$$

and the current $I_{OUT}(t)$ is $I_{out}(t)=V_{IN}(t)f_{sw}c2$.

In combination with the equation $$f_{sw} = \frac{I_{IN}(t)}{2c_1 v_0}$$

and the equation $I_{out}(t)=V_{IN}(t)f_{sW}C2$, it is known that $$V_{IN}(t)I_{IN}(t) = \frac{2I_{out}(t)v_0c_1}{c_2}.$$

$V_{IN}(t)$ represents the voltage value of the second input analog signal, $I_{IN}(t)$ represents the current value of the first input analog signal, c1 is the capacitance value of the first capacitor C1, c2 represents the capacitance value of the second capacitor C2, v0 represents the voltage value of the reference voltage Vref, and $I_{OUT}(t)$ represents the current value flowing from the first voltage signal V1 to the second voltage signal V2. The product of $V_{IN}(t)$ and $I_{IN}(t)$ is equal to two times $I_{OUT}(t)$ times v0 times c1, and then divided by c2.

From the equation $$V_{IN}(t)I_{IN}(t) = \frac{2I_{out}(t)v_0c_1}{c_2},$$

it is known that for acquisition of the product of the first input analog signal S1 and the second input analog signal S2, only the capacitance value c1 of the first capacitor C1, the capacitance value c2 of the second capacitor C2, the voltage value v0 of the reference voltage Vref, and the current value $I_{OUT}(t)$ flowing from the first voltage signal V1 to the second voltage signal V2 need to be known.

Since the capacitance value c1 of the first capacitor C1, the capacitance value c2 of the second capacitor C2, and the voltage value v0 of the reference voltage Vref are all predetermined parameters, in practice, the product of the first input analog signal S1 and the second input analog signal S2 may be acquired only by measuring the current value $I_{OUT}(t)$.

In addition, in the analog multiplier, by selecting the switch, it is possible to avoid the selection of the transistor. Since the operating range of the transistor restricts the operating range of the analog multiplier, in this case, the analog multiplier is capable of operating in a wider range.

In addition, the precision of the analog multiplier mainly depends on the matching between the first capacitor C1 and the second capacitor C2, and the change of the reference voltage Vref. Since the first capacitor C1 and the second capacitor C2 are both passive capacitors, the matching between the passive capacitors is relatively simple in design. Further, a bandgap reference voltage may be used as the reference voltage Vref. Therefore, the analog multiplier may achieve higher precision and smaller PVT variations.

Figure 8:
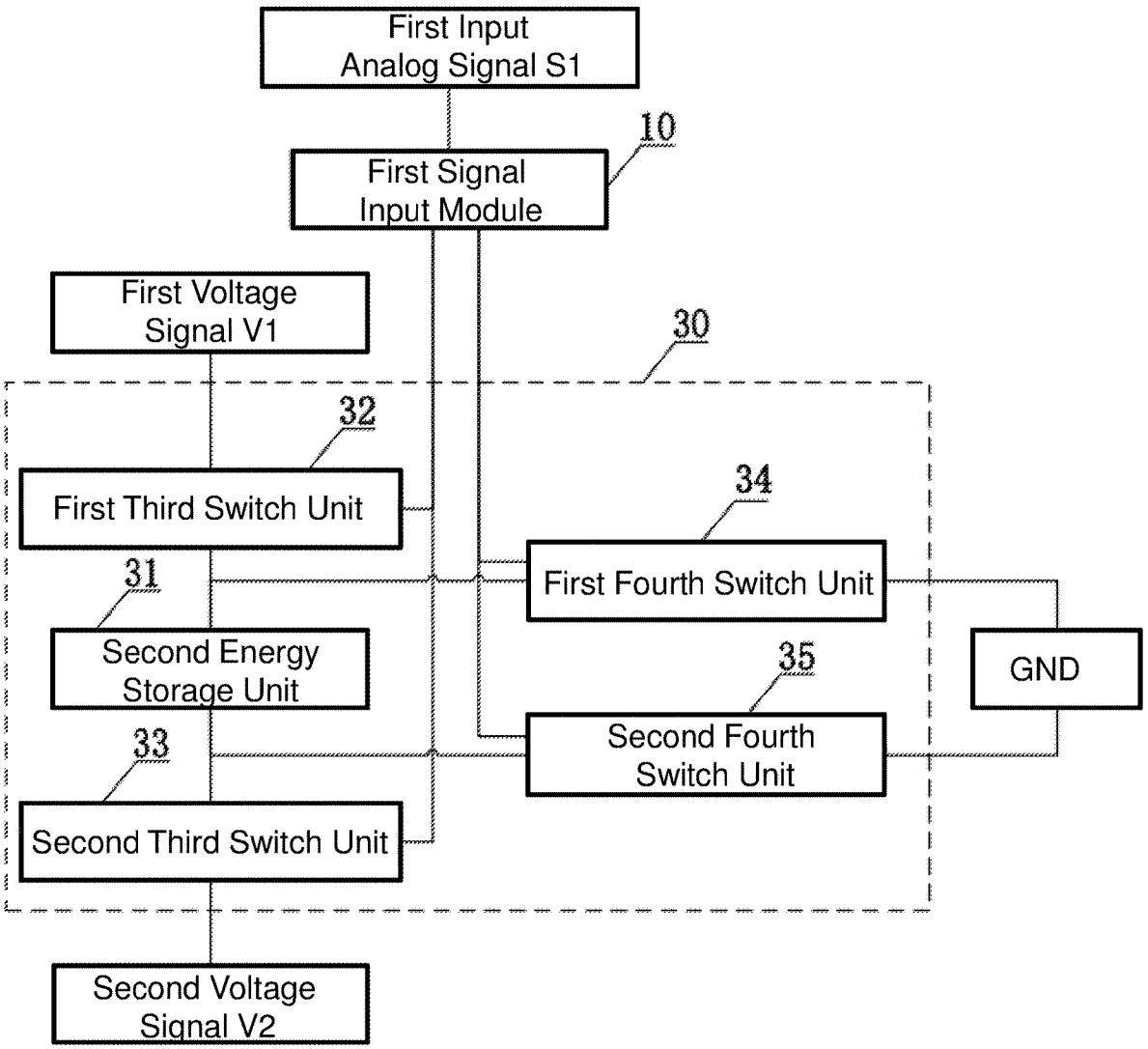
FIG. 8 is a schematic structural diagram of connection between the first signal input module and a third signal input module according to an embodiment of the present disclosure.

Referring to FIG. 8 in combination with FIG. 1, FIG. 8 is a schematic circuit structural diagram of connection between the first signal input module 10 and the third signal input module 30 according to an embodiment of the present disclosure.

The third signal input module 30 is connected to the first signal input module 10. The third signal input module 30 includes a second energy storage unit 31 and two third switch units (respectively a first third switch unit 32 and a second third switch unit 33), and two fourth switch units (respectively a first fourth switch unit 34 and a second fourth switch unit 35).

Specifically, a first terminal of the second energy storage unit 31 is connected to the first voltage signal V1 through the first third switch unit 32 and is connected to ground GND through the first fourth switch unit 34. A second terminal of the second energy storage unit 31 is connected to the second voltage signal V2 through the second third switch unit 33 and is connected to ground GND through the second fourth switch unit 35.

The second energy storage unit 31 is configured to be connected to both the first voltage signal V1 and the second voltage signal V2 in the case that the two third switch units are turned off, and to be connected to ground in the case that the two fourth switch units are turned off.

The first third switch unit 32 and the second third switch unit 33 have the same switching frequency and are simultaneously turned on or turned off. The first fourth switch unit 34 and the second fourth switch unit 35 have the same switching frequency, and are simultaneously turned on or turned off.

In addition, the first third switch unit 32 and the first fourth switch unit 34 are alternately turned on or turned off based on the frequency of the frequency modulation signal.

In addition, the first fourth switch unit 34 is turned off in the case that the first third switch unit 32 is turned on, and the first fourth switch unit 34 is turned on in the case that the first third switch unit 32 is turned off.

Likewise, the second input analog signal is a difference between the first voltage signal V1 and the second voltage signal V2. That is, the voltage of the second input analog signal is a difference between the voltage of the first voltage signal V1 and the voltage of the second voltage signal V2.

Figure 9:
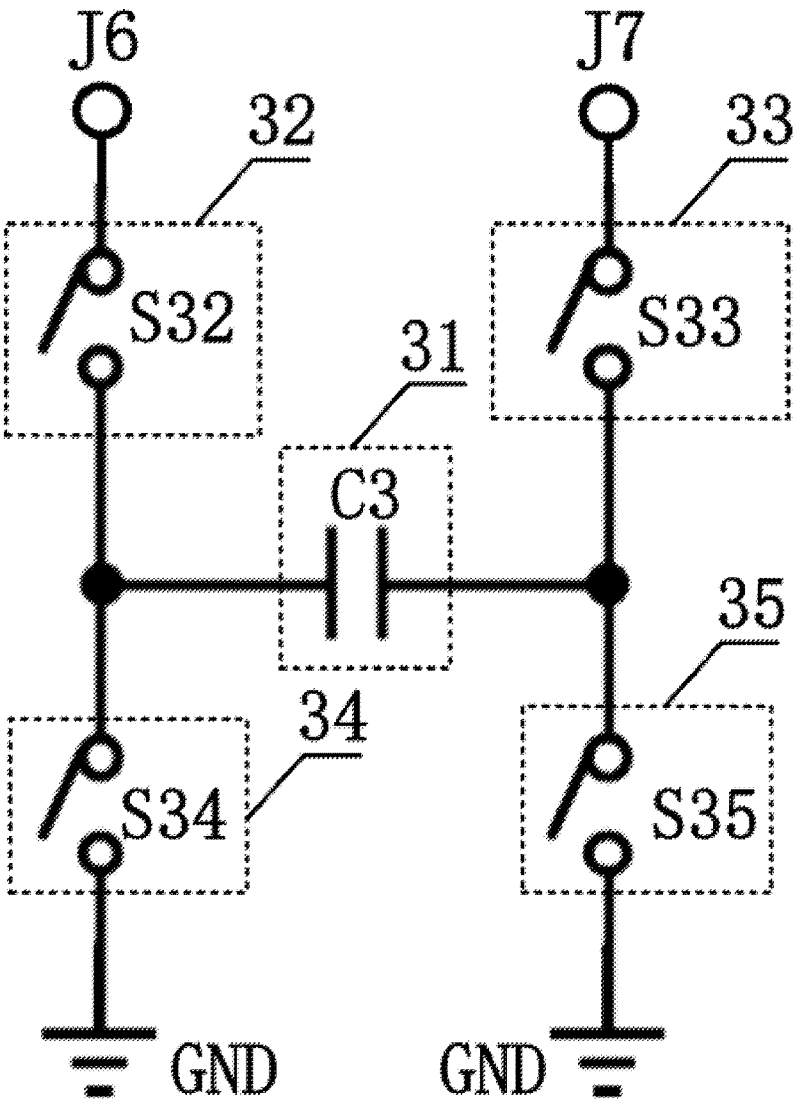
FIG. 9 is a schematic circuit structural diagram of the third signal input module according to an embodiment of the present disclosure.

Optionally, referring to FIG. 9 together, as illustrated in FIG. 9, the second energy storage unit 31 includes a third capacitor C3. A first terminal of the third capacitor C3 is connected to a first terminal of the first third switch unit 32, and a first terminal of the first fourth switch unit 34. A second terminal of the third capacitor C3 is connected to a first terminal of the second third switch unit 33 and a first terminal of the second fourth switch unit 35. A second terminal of the first third switch unit 32 is connected to the first voltage signal V1 through a port J6. A second terminal of the first fourth switch unit 34 and a second terminal of the second fourth switch unit 35 are both connected to ground GND. A second terminal of the second third switch unit 33 is connected to the second voltage signal V2 through a port J7.

Optionally, the first third switch unit 32 includes a third switch S32, and the second third switch unit 33 includes a third switch S33. The first fourth switch unit 34 includes a fourth switch S34, and the second fourth switch unit 35 includes a fourth switch S35.

In other words, each of the third switch units includes a third switch, and each of the fourth switch units includes a fourth switch.

A first terminal of the third switch S32 and a first terminal of the fourth switch S34 are both connected to the first terminal of the second energy storage unit 31 (that is, the first terminal of the third capacitor C3), and a second terminal of the third switch S32 is connected to the first voltage signal V1 through a port J6. A first terminal of the third switch S33 and a first terminal of the fourth switch S35 are both connected to the second terminal of the second energy storage unit 31 (that is, the second terminal of the third capacitor C3), and a second terminal of the third switch S33 is connected to the second voltage signal V2 through a port J7. A second terminal of the fourth switch S34 and a second terminal of the fourth switch S35 are both connected to ground GND. A control terminal of the third switch S32, a control terminal of the third switch S33, a control terminal of the fourth switch S34, and a control terminal of the fourth switch S35 are all connected to the first signal input module 10. That is, the third switch S32, the third switch S33, the fourth switch S34, and the fourth switch S35 are all controlled by the frequency modulation signal generated by the first signal input module 10.

Specifically, it may be seen from the above disclosure that the third switch S32, the third switch S33, the fourth switch S34, and the fourth switch S35 are alternately turned on based on the frequency modulation signal generated by the first signal input module 10, that is, the switching frequencies of the third switch S32, the third switch S33, the fourth switch S34, and the fourth switch S35 are equal to the frequency of the frequency modulation signal. The third switch S32 and the third switch S33 are simultaneously turned on or turned off, and the fourth switch S34 and the fourth switch S35 are simultaneously turned on or turned off.

In addition, the fourth switch S34 and the fourth switch S35 are turned off in the case that the third switch S32 and the third switch S33 are turned on, and the fourth switch S34 and the fourth switch S35 are turned on in the case that the third switch S32 and the third switch S33 are turned off.

Likewise, it is also assumed that the voltage value v1(*t*) of the first voltage signal V1 is greater than the voltage value v2(*t*) of the second voltage signal V2, then the third switch S32 and the third switch S33 are turned off. In the case that the fourth switch S34 and the fourth switch S35 are turned on, both terminals of the third capacitor C3 are short-circuited to ground GND, and the third capacitor C3 is completely discharged.

In the case that the third switch S32 and the third switch S33 are turned on, and the fourth switch S34 and the fourth switch S35 are turned off, the charge flows from the first voltage signal V1 to the second voltage signal V2 through the third capacitor C3.

The voltage applied at two terminals of the third capacitor C3 is charged to reach $V_{IN}(t)=v1(t)-v2(t)$, that is, the voltage at two terminals of the third capacitor C3 is charged to reach the voltage value $V_{IN}(t)$ of the second input analog signal S2.

In the case that the charging process is stable, the charge on the third capacitor C3 is: $Q3=V_{IN}(t)\times c3$, wherein c3 represents the capacitance of the third capacitor C3, that is, the charge on the third capacitor C3 is the product of the capacitance c3 of the third capacitor C3 and the voltage value $V_{IN}(t)$.

Then, within one cycle, the current $I_{OUT}(t)$ flowing from the first voltage signal V1 to the second voltage signal V2 is: $I_{out}(t)=V_{IN}(t)f_{sw}c3$. $f_{SW}$ represents the frequency of the frequency modulation signal output by the first signal input module 10, c3 represents the capacitance value of the third capacitor C3, and $V_{IN}(t)$ represents the voltage value of the second input analog signal S2. $I_{OUT}(t)$ is the product of $V_{IN}(t)$, $f_{SW}$, and c3.

In summary, in the case that the analog multiplier includes the first signal input module 10 and the third signal input module 30, the first input analog signal S1 and the third signal input module 30 are both related to the frequency of the frequency modulation signal, and the product of the first input analog signal S1 and the second input analog signal S2 is correspondingly calculated.

Description is given using the first signal input module 10 as illustrated in FIG. 5 and the third signal input module 30 as illustrated in FIG. 9 as examples.

In this case, as known from the above embodiments, the voltage value of the voltage VR is $Vr=I_{IN}(t)\times r1$, the frequency of the frequency modulation signal is $f_{SW}=K\times Vr$, and the current $I_{OUT}(t)$ is: $I_{out}(t)=V_{IN}(t)f_{sw}c3$.

In combination with the equation $Vr=I_{IN}(t)\times r1$, the equation $f_{SW}=K\times Vr$, and the equation $I_{out}(t)=V_{IN}(t)f_{sw}c3$, it is known that $$V_{IN}(t)I_{IN}(t)=\frac{I_{out}(t)}{K\times r1\times c3}.$$

K represents the control characteristic value of the voltage-controlled oscillator, c3 represents the capacitance value of the third capacitor C3, r1 represents the resistance value of the first resistor R1, and $I_{OUT}(t)$ represents the current value flowing through the first voltage signal V1 to the second voltage signal V2. The product of $V_{IN}(t)$ and $I_{IN}(t)$ is equal to $I_{OUT}(t)$ divided by a product of K times r1 times c3.

From the equation $$V_{IN}(t)I_{IN}(t)=\frac{I_{out}(t)}{K\times r1\times c3},$$

it is known that for acquisition of the product of the first input analog signal S1 and the second input analog signal S2, only the resistance value r1 of the first resistor R1, the capacitance value c3 of the third capacitor C3, the control characteristic value K of the voltage-controlled oscillator, and the current value $I_{OUT}(t)$ flowing from the first voltage signal V1 to the second voltage signal V2 need to be known.

Since the resistance value r1 of the first resistor R1, the capacitance value c3 of the third capacitor C3, and the control characteristic value K of the voltage-controlled oscillator are all predetermined parameters, in practice, the product of the first input analog signal S1 and the second input analog signal S2 may be acquired likewise only by measuring the current value $I_{OUT}(t)$.

It should be stressed that in the above embodiments, the following two cases are specifically described.

In a first case, description is given in combination with the first signal input module 10 as illustrated in FIG. 3 and the second signal input module 20 as illustrated in FIG. 7.

In a second case, description is given in combination with the first signal input module 10 as illustrated in FIG. 5 and the second signal input module 30 as illustrated in FIG. 9.

In other embodiments, other combinations may be employed to implement the functionality of the analog multiplier. For example, the first signal input module 10 as illustrated in FIG. 3 may be combined with the third signal input module 30 as illustrated in FIG. 9 to implement the functionality of the analog multiplier.

For another example, the first signal input module 10 as illustrated in FIG. 5 is combined with the second signal input module 20 as illustrated in FIG. 7 to implement the functionality of the analog multiplier.

In addition, the specific implementation is similar to the implementation in the above two cases, which is within the scope and easily understood by a person skilled in the art, and is not described herein any further.

In addition, in the above embodiments, the first input analog signal S1 is a current signal, and the second input analog signal S2 is a voltage signal, such that the above analog multiplier acquires the product of the voltage and the current.

In other embodiments, only a simple circuit configured to convert the voltage into the current or a circuit configured to convert the current into the voltage may be provided to acquire the product of one voltage and another voltage or the product of one current and another current.

Finally, it should be noted that the above embodiments are merely used to illustrate the technical solutions of the present disclosure rather than limiting the technical solutions of the present disclosure. Under the concept of the present disclosure, the technical features of the above embodiments or other different embodiments may be combined, the steps therein may be performed in any sequence, and various variations may be derived in different aspects of the present disclosure, which are not detailed herein for brevity of description. Although the present disclosure is described in detail with reference to the above embodiments, persons of ordinary skill in the art should understand that they may still make modifications to the technical solutions described in the above embodiments, or make equivalent replacements to some of the technical features; however, such modifications or replacements do not cause the essence of the corresponding technical solutions to depart from the spirit and scope of the technical solutions of the embodiments of the present disclosure.

What is claimed is:

1. An analog multiplier, applicable to calculating a product of a first input analog signal and a second input analog signal, the analog multiplier comprising:

a first signal input module, wherein the first signal input module is connected to the first input analog signal, and is configured to convert the first input analog signal into a frequency modulation signal with the first input analog signal as a carrier;

a second signal input module or a third signal input module, wherein:

the second signal input module is connected to the first signal input module, and the second signal input module comprises a first energy storage unit, a first switch unit, and a second switch unit, and wherein:

a first terminal of the first energy storage unit is connected to a first voltage signal through the first switch unit;

the first terminal of the first energy storage unit is connected to a second voltage signal through the second switch unit; and a second terminal of the first energy storage unit is connected to ground, and wherein the first switch unit and the second switch unit are alternately turned on or turned off based on a frequency of the frequency modulation signal, and the second switch unit is turned off in the case that the first switch unit is turned on and the second switch unit is turned on in the case that the first switch unit is turned off;

the third signal input module is connected to the first signal input module, and the third signal input module comprises a second energy storage unit, two third switch units, and two fourth switch units, and wherein:

a first terminal of the second energy storage unit is connected to the first voltage signal through a first third switch unit of the two third switch units;

the first terminal of the second energy storage unit is connected to ground through a first fourth switch unit of the two fourth switch units; and a second terminal of the second energy storage unit is connected to the second voltage signal through a second third switch unit of the two third switch units, and is connected to ground through a second fourth switch unit of the two fourth switch units, and wherein the two third switch units and the two fourth switch units are alternately turned on or turned off based on the frequency of the frequency modulation signal, and two fourth switch units are turned off in the case that the two third switch units are turned on, and are turned on in the case that the two third switch units are turned off; and the second input analog signal is a difference between the first voltage signal and the second voltage signal.

2. The analog multiplier according to claim 1, wherein the first signal input module comprises a third energy storage unit, a fifth switch unit, a comparison unit, and a control unit, and wherein:

a first terminal of the third energy storage unit is connected to the first input analog signal, a first terminal of the fifth switch unit, and a first terminal of the comparison unit;

a second terminal of the third energy storage unit and a second terminal of the fifth switch unit are both connected to ground;

the third energy storage unit is configured to be charged based on the first input analog signal in the case that the fifth switch unit is turned off, and the third energy storage unit is configured to be discharged in the case that the fifth switch unit is turned on to output a third voltage signal to the first terminal of the comparison unit;

a second terminal of the comparison unit is connected to a reference voltage;

an output terminal of the comparison unit is connected to a control terminal of the fifth switch unit;

the comparison unit is configured to output a control signal to the control terminal of the fifth switch unit based on the third voltage signal to control the fifth switch unit to be turned on or turned off; and the control unit is connected to the output terminal of the comparison unit, and the control unit is configured to acquire the frequency modulation signal based on the control signal, and wherein:

in the case that the analog multiplier comprises the second signal input module, the control unit is connected to both a control terminal of the first switch unit and a control terminal of the second switch unit; and in the case that the analog multiplier comprises the third signal input module, the control unit is connected to both a control terminal of the two third switch units and a control terminal of the two fourth switch units.

3. The analog multiplier according to claim 2, wherein the control signal is a pulse frequency modulation signal with the first input analog signal as the carrier; and the frequency modulation signal is a square-wave frequency modulation signal with the first input analog signal as the carrier.

4. The analog multiplier according to claim 2, wherein the third energy storage unit comprises a first capacitor, and wherein a first terminal of the first capacitor is connected to the first input analog signal, and a second terminal of the first capacitor is connected to ground.

5. The analog multiplier according to claim 2, wherein the fifth switch unit comprises a fifth switch, and wherein:

a first terminal of the fifth switch is connected to the first terminal of the third energy storage unit;

a second terminal of the fifth switch is connected to ground; and a control terminal of the fifth switch is connected to the output terminal of the comparison unit.

6. The analog multiplier according to claim 2, wherein the comparison unit comprises a comparator, and wherein:

a first input terminal of the comparator is connected to the first terminal of the third energy storage unit;

a second input terminal of the comparator is connected to the reference voltage; and an output terminal of the comparator is connected to the control terminal of the fifth switch unit and the control unit.

7. The analog multiplier according to claim 2, wherein the control unit comprises a D flip-flop, and wherein:

a clock input terminal of the D flip-flop is connected to the output terminal of the comparison unit;

an inverting output terminal of the D flip-flop is connected to a data input terminal of the D flip-flop and the control terminal of the second switch unit; and a non-inverting output terminal of the D flip-flop is connected to the control terminal of the first switch unit.

8. The analog multiplier according to claim 7, wherein:

in the case that the first input analog signal is a current, the frequency of the frequency modulation signal is $$f_{sw} = \frac{I_{IN}(t)}{2c_1 v_0},$$

wherein $I_{IN}(t)$ represents a current value of the first input analog signal, c1 represents a capacitance value of a first capacitor of the third energy storage unit, and v0 represents a voltage value of the reference voltage.

9. The analog multiplier according to claim 1, wherein the first signal input module comprises a first resistor and a voltage-controlled oscillator, and wherein a first terminal of the first resistor is connected to an input terminal of the voltage-controlled oscillator, and a second terminal of the first resistor is connected to ground, and wherein:

in the case that the analog multiplier comprises the second signal input module, an output terminal of the voltage-controlled oscillator is connected to both a control terminal of the first switch unit and a control terminal of the second switch unit; and in the case that the analog multiplier comprises the third signal input module, the output terminal of the voltage-controlled oscillator is connected to both a control terminal of the two third switch units and a control terminal of the two fourth switch units.

10. The analog multiplier according to claim 1, wherein the first energy storage unit comprises a second capacitor, and wherein:

a first terminal of the second capacitor is connected to a first terminal of the first switch unit and a first terminal of the second switch unit;

a second terminal of the second capacitor is connected to ground;

a second terminal of the first switch unit is connected to the first voltage signal; and a second terminal of the second switch unit is connected to the second voltage signal.

11. The analog multiplier according to claim 10, wherein in the case that the analog multiplier comprises the second signal input module and a voltage value of the first voltage signal is greater than a voltage value of the second voltage signal, a current $I_{OUT}(t)$ flowing from the first voltage signal to the second voltage signal is $I_{out}(t)=V_{IN}(t)f_{sw}c2$, wherein $f_{SW}$ represents the frequency of the frequency modulation signal, c2 represents a capacitance value of the second capacitor, and $V_{IN}(t)$ represents a voltage value of the second input analog signal.

12. The analog multiplier according to claim 1, wherein the first switch unit comprises a first switch; and the second switch unit comprises a second switch, and wherein:

a first terminal of the first switch is connected to the first terminal of the first energy storage unit;

a second terminal of the first switch is connected to the first voltage signal;

a control terminal of the first switch is connected to the first signal input module;

a first terminal of the second switch is connected to the first terminal of the first energy storage unit;

a second terminal of the second switch is connected to the second voltage signal; and a control terminal of the second switch is connected to the first signal input module.

13. The analog multiplier according to claim 1, wherein the second energy storage unit comprises a third capacitor, and wherein:

a first terminal of the third capacitor is connected to a first terminal of the first third switch unit and a first terminal of the first fourth switch unit;

a second terminal of the third capacitor is connected to a first terminal of the second third switch unit and a first terminal of the second fourth switch unit;

a second terminal of the first third switch unit is connected to the first voltage signal;

a second terminal of the first fourth switch unit and a second terminal of the second fourth switch unit are both connected to ground; and a second terminal of the second third switch unit is connected to the second voltage signal.

14. The analog multiplier according to claim 13, wherein in the case that the analog multiplier comprises the third signal input module and a voltage value of the first voltage signal is greater than a voltage value of the second voltage signal, a current $I_{OUT}(t)$ flowing from the first voltage signal to the second voltage signal is $I_{out}(t)=V_{IN}(t)f_{sw}c3$, wherein $f_{SW}$ represents the frequency of the frequency modulation signal, c3 represents a capacitance value of the third capacitor, and $V_{IN}(t)$ represents a voltage value of the second input analog signal.

15. The analog multiplier according to claim 1, wherein the first third switch unit comprises a first third switch, and the second third switch unit comprises a second third switch; and the first fourth switch unit comprises a first fourth switch, and the second fourth switch unit comprises a second fourth switch, and wherein:

a first terminal of the first third switch and a first terminal of the first fourth switch are both connected to the first terminal of the second energy storage unit;

a second terminal of the first third switch is connected to the first voltage signal;

a first terminal of the second third switch and a first terminal of the second fourth switch are both connected to the second terminal of the second energy storage unit;

a second terminal of the second third switch is connected to the second voltage signal;

a second terminal of the first fourth switch and a second terminal of the second fourth switch are both connected to ground; and a control terminal of the first third switch, a control terminal of the second third switch, a control terminal of the first fourth switch and a control terminal of the second fourth switch are connected to the first signal input module.

* * * * *